US009303960B2

(12) United States Patent
Uhr

(10) Patent No.: US 9,303,960 B2
(45) Date of Patent: Apr. 5, 2016

(54) ELECTRONIC TARGET FOR SIMULATED SHOOTING

(71) Applicant: Oren Uhr, Rishon LeZion (IL)

(72) Inventor: Oren Uhr, Rishon LeZion (IL)

( * ) Notice: Subject to any disclaimer, the term of this patent is extended or adjusted under 35 U.S.C. 154(b) by 268 days.

(21) Appl. No.: 13/733,846

(22) Filed: Jan. 3, 2013

(65) Prior Publication Data

US 2014/0125973 A1 May 8, 2014

Related U.S. Application Data

(60) Provisional application No. 61/723,306, filed on Nov. 6, 2012.

(51) Int. Cl.

| | |
|---|---|
| ***A63F 13/10*** | (2006.01) |
| ***F41J 5/02*** | (2006.01) |
| ***F41J 5/08*** | (2006.01) |

(52) U.S. Cl.
CPC ..... *F41J 5/02* (2013.01); *F41J 5/08* (2013.01)

(58) Field of Classification Search
CPC ..... G06F 3/042
USPC ..... 273/371; 463/37
See application file for complete search history.

(56) References Cited

U.S. PATENT DOCUMENTS

| | | | |
|---|---|---|---|
| 3,995,376 | A | 12/1976 | Kimble et al. |
| 4,048,489 | A | 9/1977 | Giannetti |
| 4,678,437 | A | 7/1987 | Scott et al. |
| 5,119,576 | A | 6/1992 | Eming |
| 5,344,320 | A | 9/1994 | Inbar et al. |
| 5,363,769 | A | 11/1994 | Bellak et al. |
| 5,488,795 | A | 2/1996 | Sweat |
| 5,599,187 | A | 2/1997 | Mesiano |
| 5,636,992 | A | 6/1997 | Mastrangelo |
| 5,685,106 | A | 11/1997 | Shoham |
| 5,842,300 | A | 12/1998 | Cheshelski et al. |
| 5,909,951 | A | 6/1999 | Johnson at al. |
| 6,322,365 | B1 | 11/2001 | Shechter et al. |
| 6,579,098 | B2 | 6/2003 | Shechter |
| 6,604,064 | B1 | 8/2003 | Wolff et al. |
| 6,799,971 | B2 | 10/2004 | Healy et al. |
| 6,869,285 | B1 | 3/2005 | Jones, II |
| 6,966,775 | B1 | 11/2005 | Kendir et al. |
| 8,568,143 | B2 | 10/2013 | Uhr |

(Continued)

FOREIGN PATENT DOCUMENTS

| | | | |
|---|---|---|---|
| WO | WO 2005/086592 | A2 | 9/2005 |
| WO | WO 2007/057890 | A2 | 5/2007 |
| WO | WO 2007/060655 | A2 | 5/2007 |

*Primary Examiner* — Paul A D'Agostino
*Assistant Examiner* — Ankit Doshi
(74) *Attorney, Agent, or Firm* — Law Office of Arthur M. Antonelli, PLLC

(57) ABSTRACT

The present invention is directed to an electronic target for use with a pulsed beam of laser light. The electronic target may include a housing, which includes a window and a solar cell. The solar cell may be disposed in the window for receiving a pulsed beam of light that may be emitted from a gun barrel or simulated weapon. The beam of light may have a predominant wavelength of between approximately 635 nm and 650 nm, as well as a pulse duration of between 1 ms and 50 ms, and a pulse modulation frequency of approximately 2 KHz. The electronic target may be tuned to the emission characteristics of the beam of light. The electronic target may be used to count a user's consecutive hits, drill how quickly a user can place a shot of laser light on the electronic target, and simulate a magazine change or burst shooting.

20 Claims, 14 Drawing Sheets

(56) References Cited

U.S. PATENT DOCUMENTS

| | | | |
|---|---|---|---|
| 8,584,587 | B2 | 11/2013 | Uhr |
| 9,163,904 | B2 | 10/2015 | Ohr |
| 2002/0012898 | A1 | 1/2002 | Shechter et al. |
| 2002/0197584 | A1 | 12/2002 | Kendir et al. |
| 2003/0003424 | A1 | 1/2003 | Shechter et al. |
| 2003/0136900 | A1 | 7/2003 | Shechter et al. |
| 2005/0191601 | A1 | 9/2005 | Dvorak |
| 2010/0203483 | A1 | 8/2010 | Jones et al. |
| 2011/0059798 | A1* | 3/2011 | Pryor ..... 463/37 |
| 2011/0207088 | A1 | 8/2011 | Uhr |

* cited by examiner

ELECTRONIC TARGET FOR SIMULATED SHOOTING

CROSS REFERENCE TO RELATED APPLICATIONS

This application claims the benefit of U.S. patent application Ser. No. 61/723,306 filed on Nov. 6, 2012, the entire disclosure of which is incorporated by reference herein.

FIELD OF THE INVENTION

The present invention generally relates to a device and system for simulating live fire training from a wide variety of handheld firearms. More particularly, this invention relates to a microprocessor controlled electronic target, which incorporates a target area defined by a solar cell, that may be activated by incident beams of light emitted from a firearm or simulated firearm. The invention also relates to a method for using the electronic target to conduct non-live fire training with a firearm when using suitable light emitting ammunition.

BACKGROUND

Non-live fire training—repeated drawing, aiming and firing without ammunition—is a practical, convenient way to improve and/or maintain shooting techniques. The practice is limited, however, by the fact that the bullet impact point is a mere assumption; thus the trainees and/or trainers are limited in their ability to evaluate the trainee's performance or improve their skills. Furthermore, there has long existed the need for an apparatus and system whereby a single or multiple user, or trainer and trainee, can readily practice using a firearm without placing themselves or others at risk of accidental discharge of the firearm while still maintaining the ability to recognize the "hits." This safety imperative coincides with an added desire to limit the financial burden related to the wear and tear on a firearm, including cost of ammunition and use of adequate facilities brought about by live fire training. Accordingly, a need exists for an alternative to traditional firearm training which addresses these concerns and maintains the overall benefit of live fire training without live ammunition.

SUMMARY

Hence, the present invention is directed to an electronic target and system for conducting and evaluating firearm training.

One aspect of the present invention relates to an electronic target for use with a pulsed beam of visible light. The beam of light may have a predominant wavelength of between approximately 635 nm and 650 nm, a pulse duration of between 1 ms and 50 ms, and a pulse modulation frequency of approximately 2 KHz. The electronic target may include a housing, which includes a window and a solar cell that includes first and second terminals. The solar cell may be disposed adjacent the window for receiving a pulsed beam of visible light, which may be emitted from a gun barrel (or simulated weapon). The beam of light may possess a predominant wavelength of between approximately 635 nm and 650 nm. The beam of light may have a pulse duration of between 1 ms and 50 ms.

In another aspect of the invention, the electronic target may further include an electronic display adjacent to the solar cell for displaying visual data, as well as a plurality of input switches adjacent the electronic display for regulating operation of the target. The electronic target further may include an audio signaling device for outputting audio data.

The electronic target may include a sensor module electrically connected to the first and second terminals of the solar cell for passing transient electrical signals from the solar cell. A signal amplification module may be electrically connected to the sensor module for amplifying transient electrical signals from the sensor module. A filtering and pulse signal train generation module may be electrically connected to the signal amplification module for passing transient electrical signals of selected bandwith (or range of frequencies) from the signal amplification module and converting the transient electrical signals of selected bandwith into a pulse train signal.

Further, the electronic target may be electrically connected to the plurality of input switches for receiving input signals from the plurality of input switches. An electronic display module may be electrically connected to the electronic display. Also, an audio circuit may be connected to the audio signaling device for transmitting audio output data.

A microcontroller may be electrically connected to the filtering and pulse signal train generation module, input switch circuitry, electronic display module, and audio circuit for controlling functionality of the electronic target.

In another aspect of the invention, the electronic target may include a power module, which electrically connects the microcontroller to first and second power supply terminals. Further, the electronic target may include a power supply that is electrically connected to the first and second power supply terminals. The power supply may include a plurality of batteries. The plurality of batteries may be two AA batteries or two AAA batteries.

In another aspect of the invention, the plurality of input switches may include first, second and third normally open switches. The first, second, and third normally open switches may be push button switches. The first, normally open switch may be a power switch such that depressing the power switch moves the target between a first state in which the target is operational and a second state in which the target is not operational.

The first state may include a plurality of operational modes. The plurality of operational modes may include first, second, third, fourth and fifth operational modes. The first operational mode may include executing a general program upon startup. The general program may include retrieving the current mode from the microcontroller memory, and displaying the current mode identification on the electronic display. Further, the general program may include executing the current mode subroutine.

In another aspect of the invention, the second normally open switch may be a mode selection switch such that depressing the mode selection switch advances the target between the second, third, and fourth operational modes. The second operational mode may include executing subroutine P1, the third operational state may include executing subroutine P2, and the fourth operational mode may include executing subroutine P3. Further still, the fifth operational state may include executing the mode selection subroutine.

In yet another aspect of the invention, the electronic target may be used to drill a magazine change for a gun by initiating an operational mode of the electronic target, receiving an incident beam of light having a predominant wavelength of between approximately 635 nm and 650 nm and a pulse duration of between 1 ms and 50 ms on the solar cell, capturing an electrical signal generated by the solar cell from the incident beam of light, filtering the electrical signal through a filtering and pulse signal train generation module; detecting the incident emission of pulsed laser light on the solar cell, and displaying a hit count on the electronic display.

DESCRIPTION OF THE DRAWINGS

The accompanying drawings, which are incorporated herein and constitute part of this specification, illustrate an embodiment of the invention, and together with the general description given above and the detailed description given below, serve to explain the features of the invention.

DESCRIPTION

Figure 1:
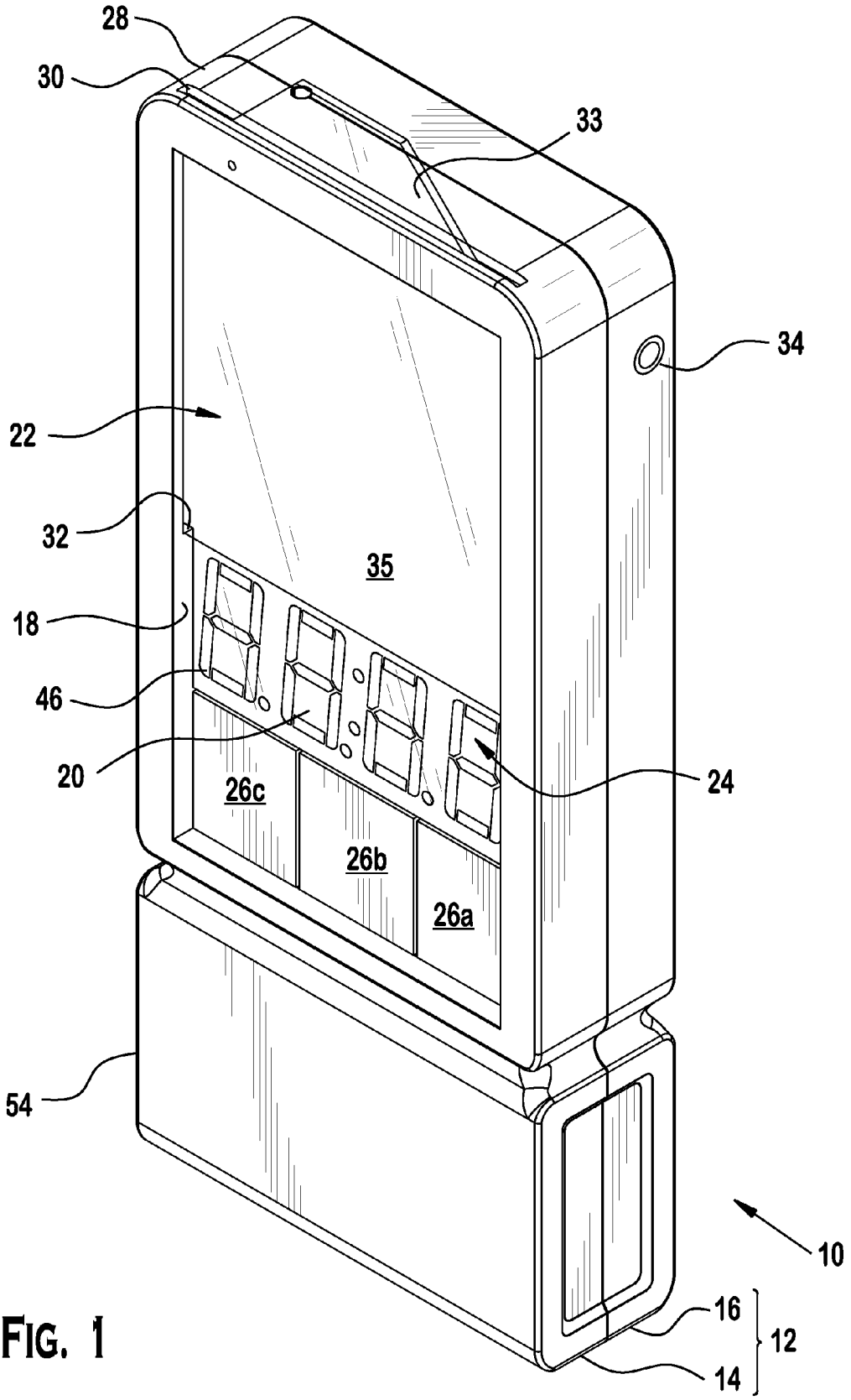
FIG. 1 is a perspective view of an embodiment of the electronic target of the present invention.
Figure 2:
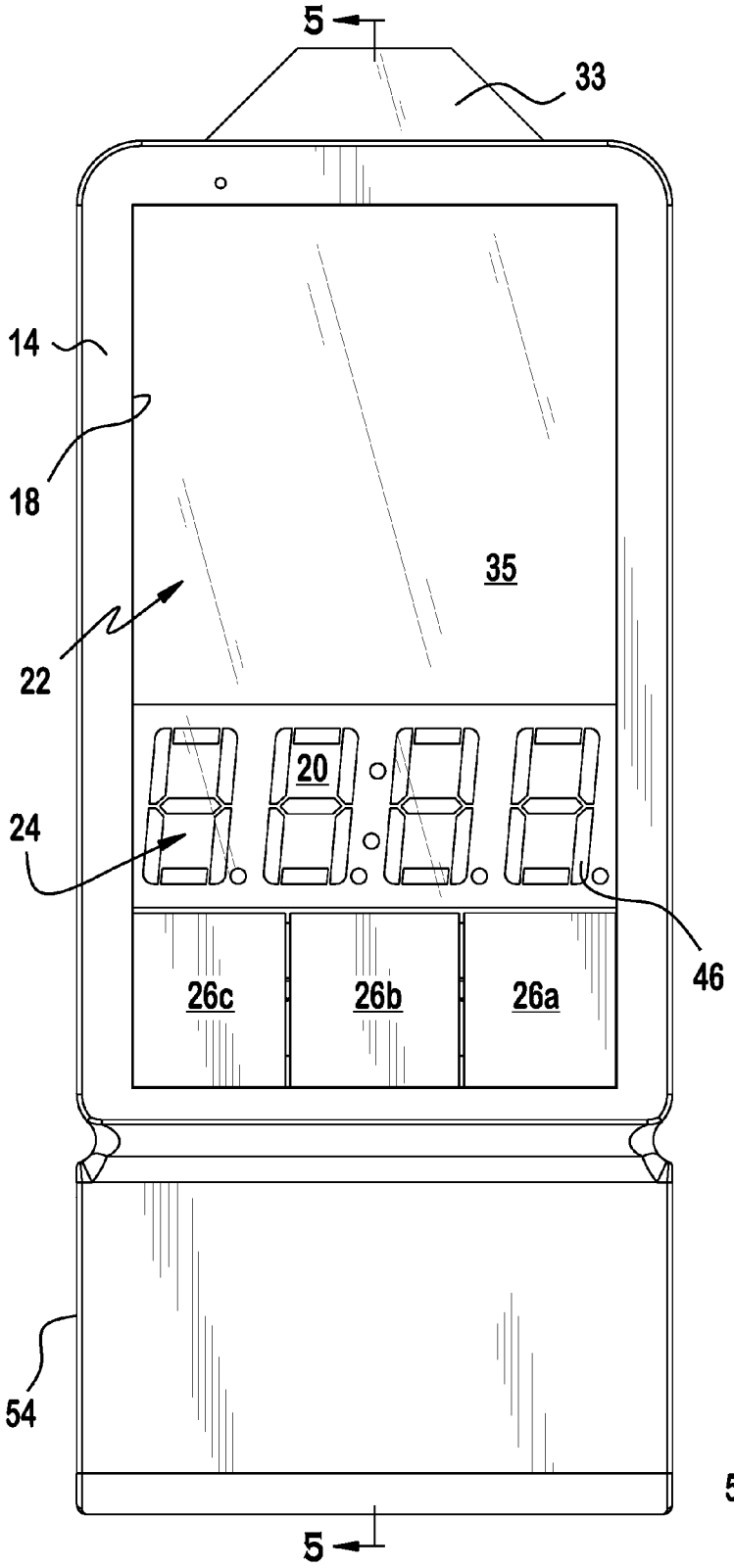
FIG. 2 is front view of the target of FIG. 1.
Figure 5:
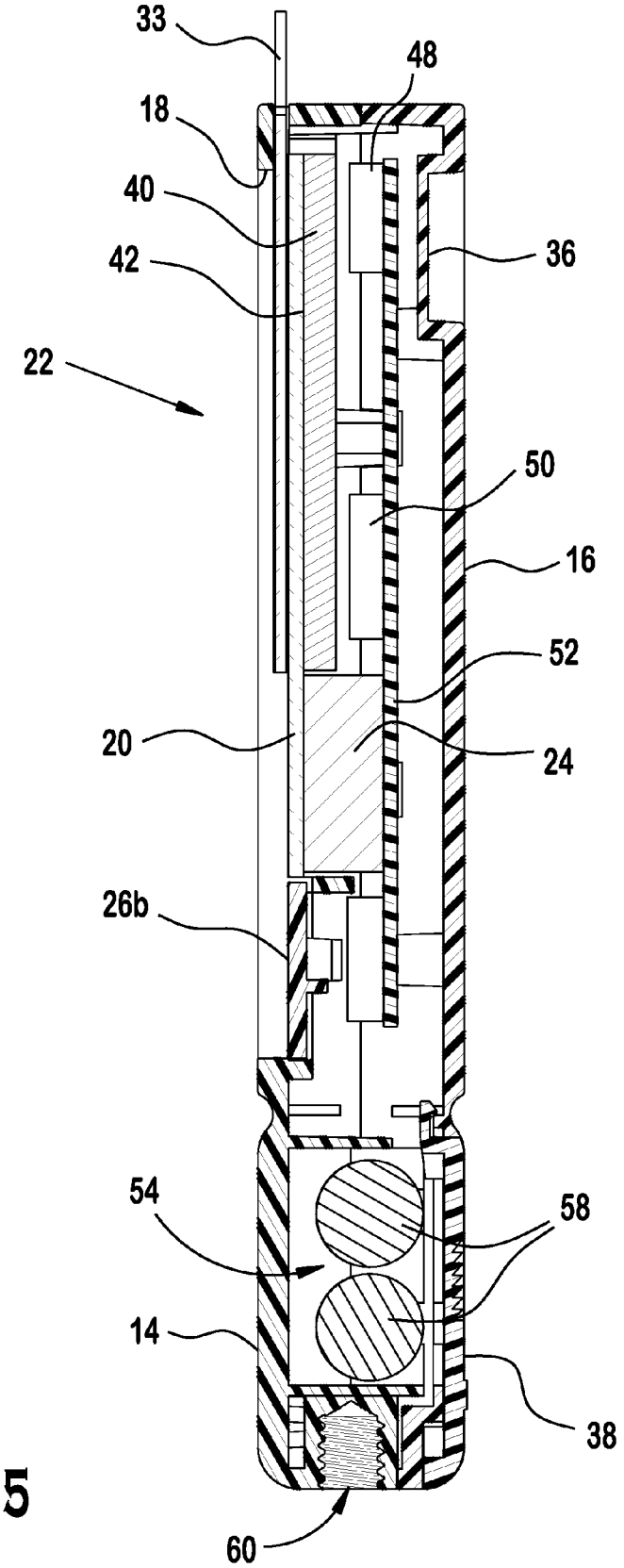
FIG. 5 is a cross sectional view of the target of FIG. 2, along line 5-5.

FIG. 1 depicts a perspective view of the electronic target 10 of the present invention. The target includes a housing 12 that is formed from a front cover 14 and rear cover 16. The housing may be formed from metal or thermoplastic materials. The front side of the housing includes a target window 18. Inside the target window 18 is a target area 22, an electronic display 24, and three input switches 26*a*, 26*b*, 26*c* that regulate operation of the device. Referring to FIGS. 1, 2 and 5, a protective sheet 20 extends over the target area 22 and the electronic display 24.

As shown in FIG. 1, the top side of the housing 12 may include a slot 30, which extends from the top surface 28 of the front cover to the target window. The slot, which may be wider than the target window, continues inside the front cover approximately half way down the vertical length of the window so as to be coextensive with the target area 22. The slot terminates at an end wall 32 on the inside of the front cover. A target mask 33 may be disposed in the slot 30. The target mask may be used to modify the effective size, shape or light transmitting properties of the target area 22.

Figure 3:
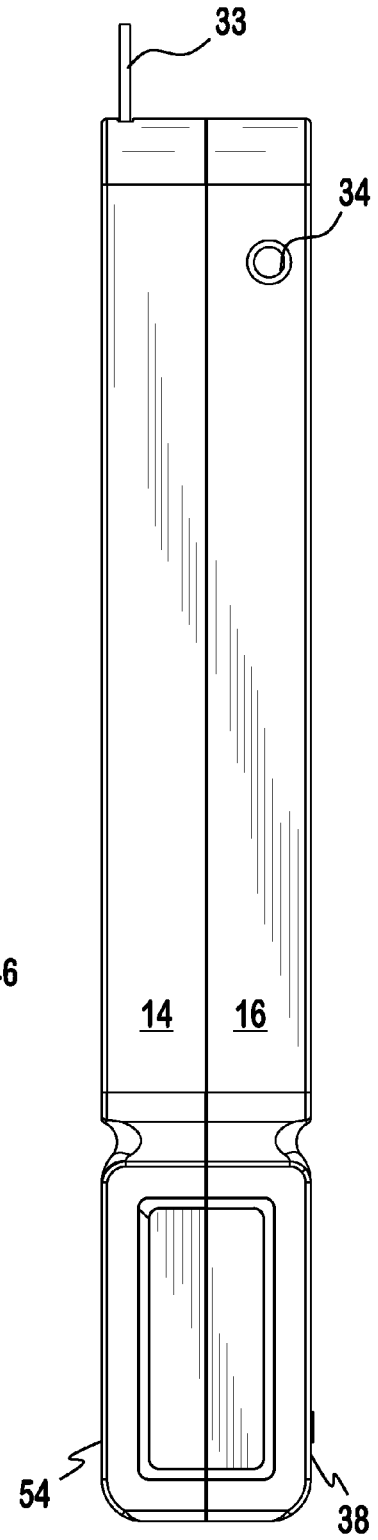
FIG. 3 is a side view of the target of FIG. 1.
Figure 4:
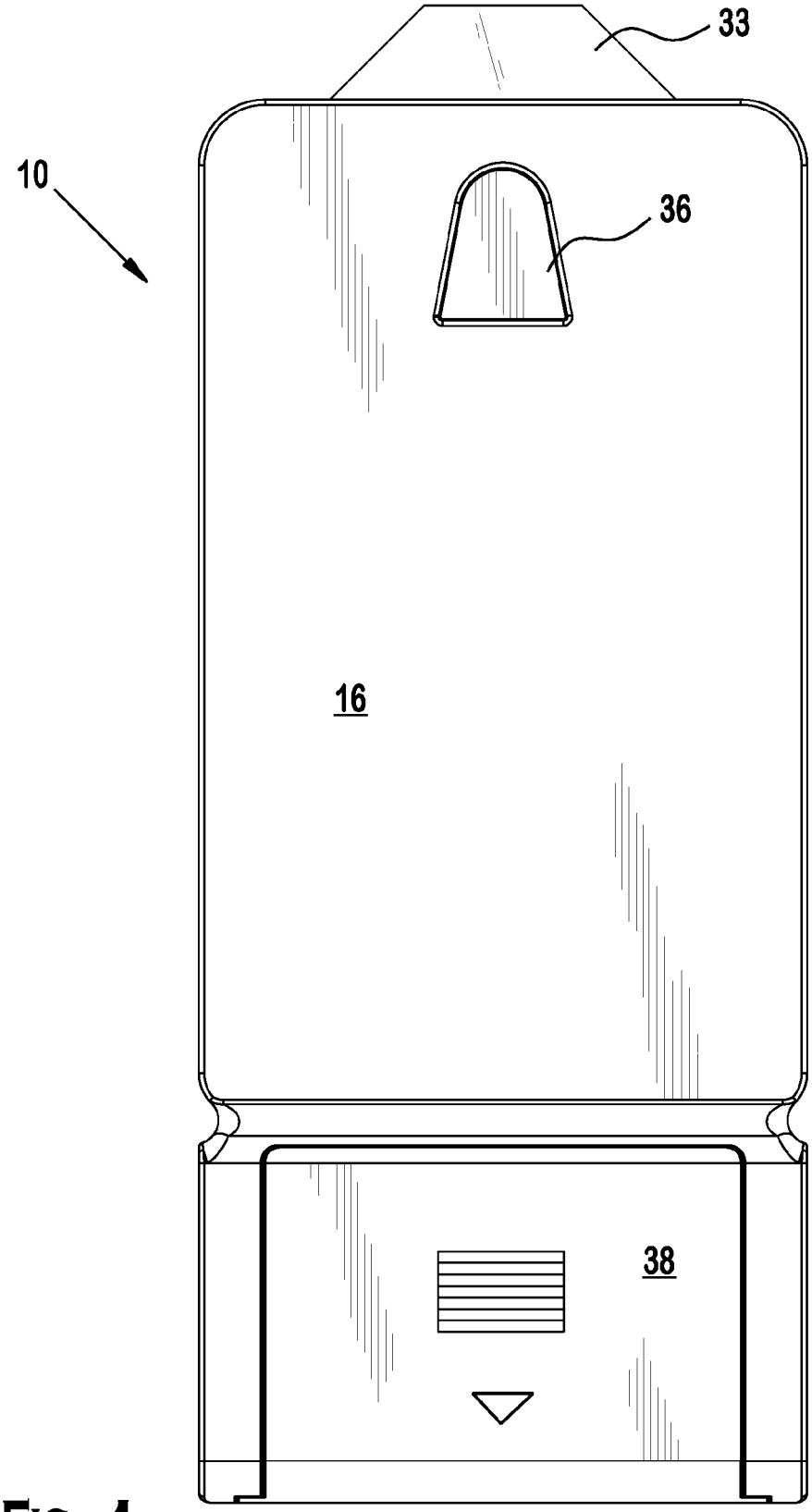
FIG. 4 is a rear view of the target of FIG. 1.

Referring to FIGS. 1 and 3, the housing may include a phone jack 34 on the upper right side of the rear cover. Additionally the housing, as shown in FIG. 4, may include a mounting receptacle 36 near the top of the rear cover and a cover 38 for a battery storage compartment 54 near the base of the rear cover. Also, the housing may include indicia, such as a company name, logo or decorative features. In a preferred embodiment, the electronic target is has a length of approximately 100 mm, a width of approximately 70 mm, and a thickness of approximately 20 mm.

Referring to FIG. 5, the electronic target is built around a solar cell 40 that is disposed behind the target window. Generally, the solar cell (or photovoltaic cell) 40 converts energy of incident light directly into electricity by the photovoltaic effect. When exposed to light, the solar cell may generate and support an electric current without being attached to any external voltage source. The solar cell may work in three steps: photons in light may hit the solar cell and become absorbed by semiconducting materials, such as silicon; electrons may be knocked loose from their atoms, causing an electric potential difference; and current may start flowing through the material to cancel the potential producing a usable amount of direct current (DC) electricity at the terminals of the solar cell.

The solar cell 40 may be made from polycrystalline silicon. Other suitable materials (e.g., monocrystalline silicon, amorphous silicon or organic solar cells), however, may be used in the solar cell, provided the solar cell converts light into a suitable amount of direct current (DC) electricity. In the disclosed embodiment, the solar cell is approximately 50 mm wide and 50 mm in length. The active side 42 of the solar cell 40 faces the target window 18. The terminals of the solar cell (not shown) may be electrically connected to a sensor circuit or module as described in connection with FIG. 7.

As described above, the protective sheet 20 may be disposed on the active side of the solar cell to protect the solar cell from abrasion and impact. The protective sheet may extend within part (or all) of the target window provided the internal components of the electronic target are protected and suitable access is provided for a user to operate the three input switches. The protective sheet may be formed from glass or plastic. In a preferred embodiment, the protective sheet is made from a transparent thermoplastic material. One such material is poly(methyl methacrylate) (PMMA), which is a lightweight or shatter-resistant alternative to glass. PMMA may be sold under a variety of brand names and may be generically referred to as acrylic glass. For example, one suitable acrylic glass is Perspex®.

Although a clear sheet of acrylic glass may be preferred in order to maintain higher levels of transmission of visible light (e.g., 92%), colored acrylic glass may be useful in filtering out ambient light so as to allow the solar cell to more accurately register incident light from the dry fire training device (e.g., laser bullet). For example, a red or dark red acrylic glass sheet may be preferred to a clear acrylic glass sheet for certain product needs (e.g., use outdoors on bright days). Alternatively, a thin plastic film may be used as a light filter in conjunction with a clear protective sheet for a desired incident light response.

Referring to FIG. 2, adjacent to the solar cell 40 is the electronic display 24. The electronic display provides visual information to the user regarding the state of the electronic target, as well as feedback concerning dry fire training metrics (e.g., hits per interval, reaction time). The electronic display may include a numeric, alphanumeric, or graphic display. For example, the electronic display may include a numeric LED display 46 that includes 4 digit displays and one decimal display. The numeric LED display may be connected to an electronic display control circuit that includes five PMOS (p-type metal-oxide-semiconductor field effect transistors (MOSFETs)), which in turn may be connected to the microcontroller. The numeric LED 46 display may emit red light (approximately 640 nm), but other LED display colors may be used (e.g., yellow green (approximately 572 nm), pure green (approximately 525 nm), yellow (approximately 590 nm), blue (approximately 430 nm), and pure blue (approximately 470 nm)).

Adjacent the electronic display 24 are three input switches 26*a*, 26*b*, 26*c* that regulate operation of the device. Each input switches may be a biased, momentary push-button switch that is a "push-to-make" (or normally-open or NO) switch, which makes contact when the button is pressed and breaks when the button is released. Other suitable switches, however, may be used.

The first input switch 26*a* is the "On~Off" (or power) switch. The power switch may be located on the right side of the three input switches. The switch turns the device on when it is off and turns the device off when it is on. Preferably, the device does not draw current from the power supply when it is turned off in order to reduce power consumption.

The second input switch 26*b* is the "mode" switch. The mode switch may be located in the middle of the three input switches. This switch is used to select operating modes of the electronic device when the electronic target is on. For example, depressing the mode switch will cause the current operating mode to be displayed on the electronic display and depressing the switch a second time within two seconds will change the operational mode of the electronic device to the next mode within a predetermined and repeating sequence (e.g., P1>P2>P2>P3>P1). By contrast, if the mode switch is not depressed a second time within the two second interval, the current operating mode will be displayed in the electronic display and the device will proceed to operate in the current operating mode.

The third input switch 26*c* is the "reset" switch. The reset switch may be located on the left side of the three input switches. When the electronic target is in one of the training modes (P1, P2 or P3), the reset switch will return the current operational mode to the beginning of that subroutine.

Figure 6:
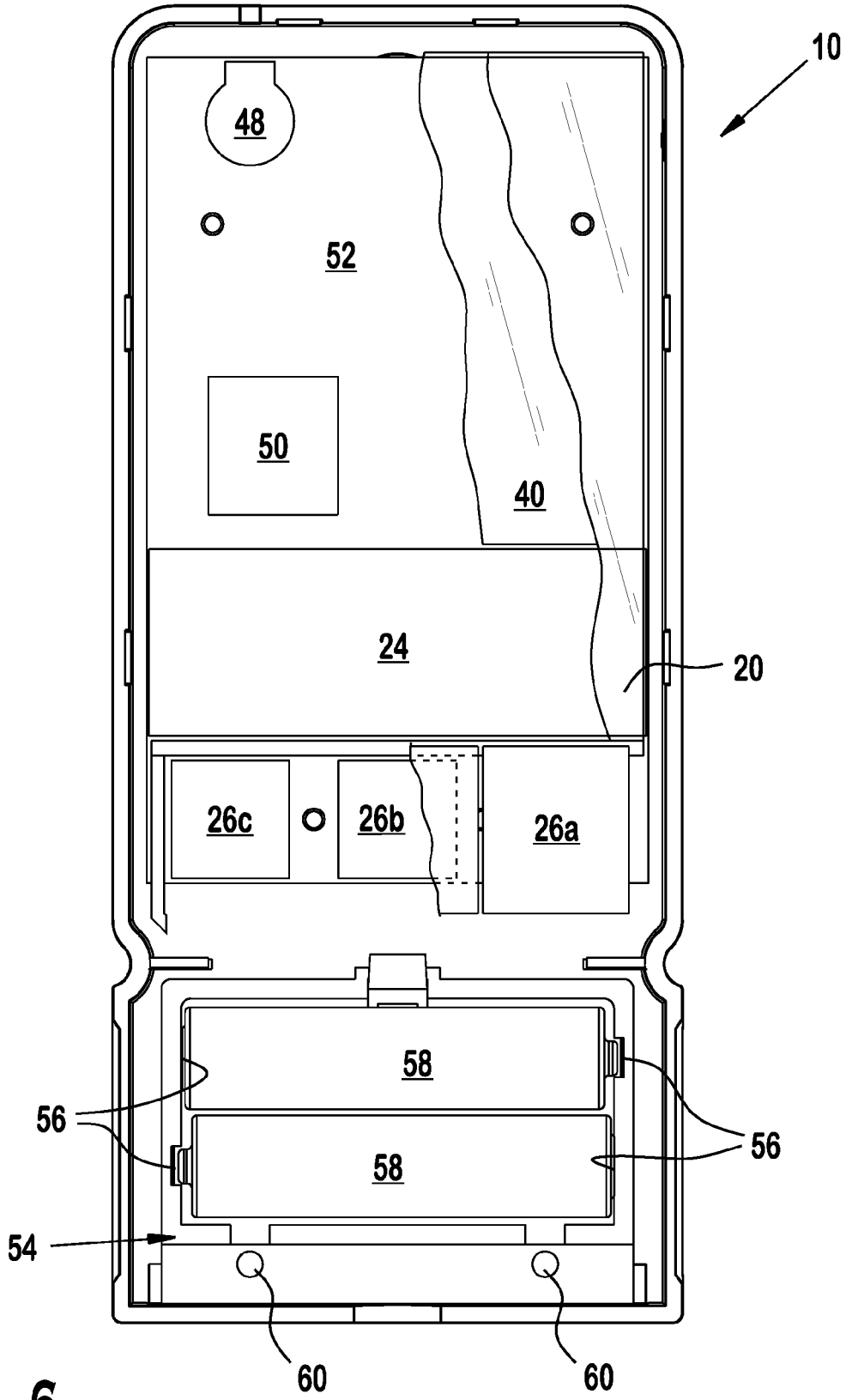
FIG. 6 is a front view of interior components of the target of FIG. 1.

As shown in FIG. 6, the electronic device may include an audio alarm device 48 that emits a "beep" during certain stages of the target's operation in order to alert or signal the user.

Referring to FIG. 5, the electronic target may further includes a microcontroller (or MCU) 50. The microcontroller 50 may be a single chip that contains a processor (the CPU), non-volatile memory for the program (ROM or flash), volatile memory for input and output (RAM), a clock and an I/O control unit. The microcontroller 50 may be contained on a circuit board 52 beneath the solar cell, along with other circuits, modules and electronic devices such as those described herein.

Referring to FIGS. 5 and 6, a battery storage compartment 54 may be provided at the end of the housing opposite the solar cell 40. Access to the compartment 54 may be provided by a removable cover 38 on the back of the target (FIG. 5). The storage compartment may house a power supply 58 that is electrically connected to the electronic components of the target. In the embodiment shown in FIG. 6, power supply terminals 56 are configured to receive two AAA batteries (in series) in order to deliver 3V of power to a power module. The power module may connect the power supply to the electronic components of the device. Additionally, the power module may serve as a power regulator, surge protector, and reverse polarity protector.

Figure 16:
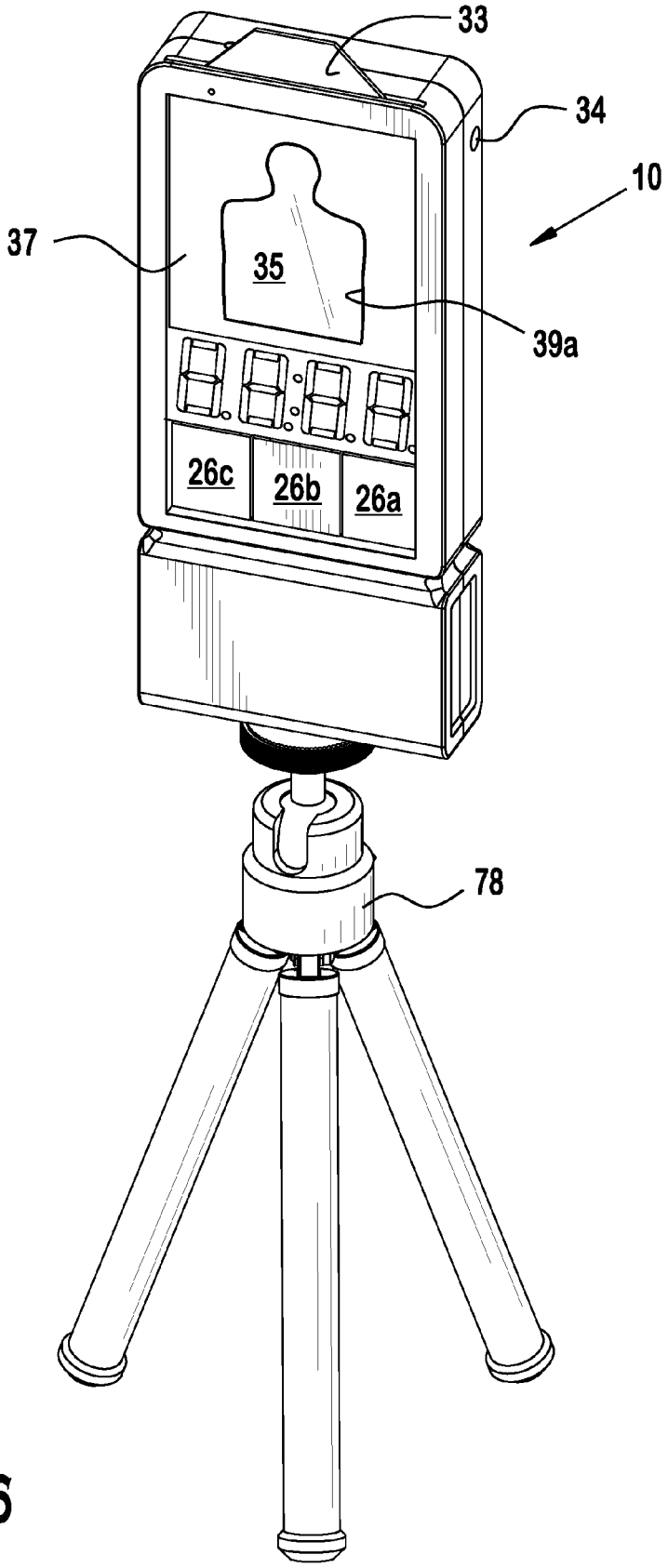
FIG. 16 is a perspective view of a support accessory in use with the target of FIG. 1.
Figure 17:
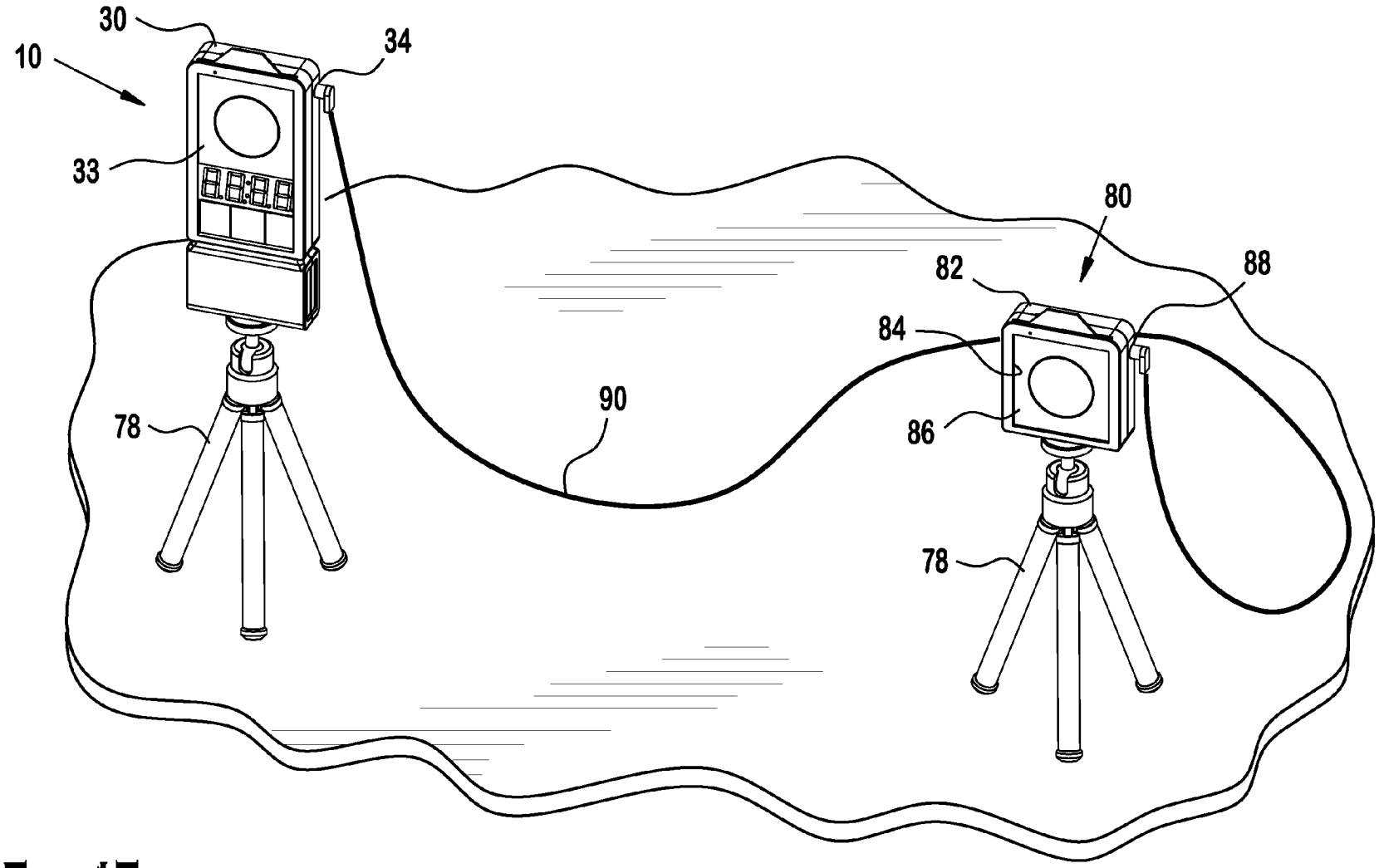
FIG. 17 is a diagram of the target of FIG. 1 connected to a second solar cell sensor target.

Beneath the battery storage compartment is a threaded bore 60. The threaded bore 60 is configured and adapted to receive a mating screw. The mating screw may be used to couple the electronic target to another device such as a tripod or stand, as shown in FIGS. 16-17.

Figure 7:
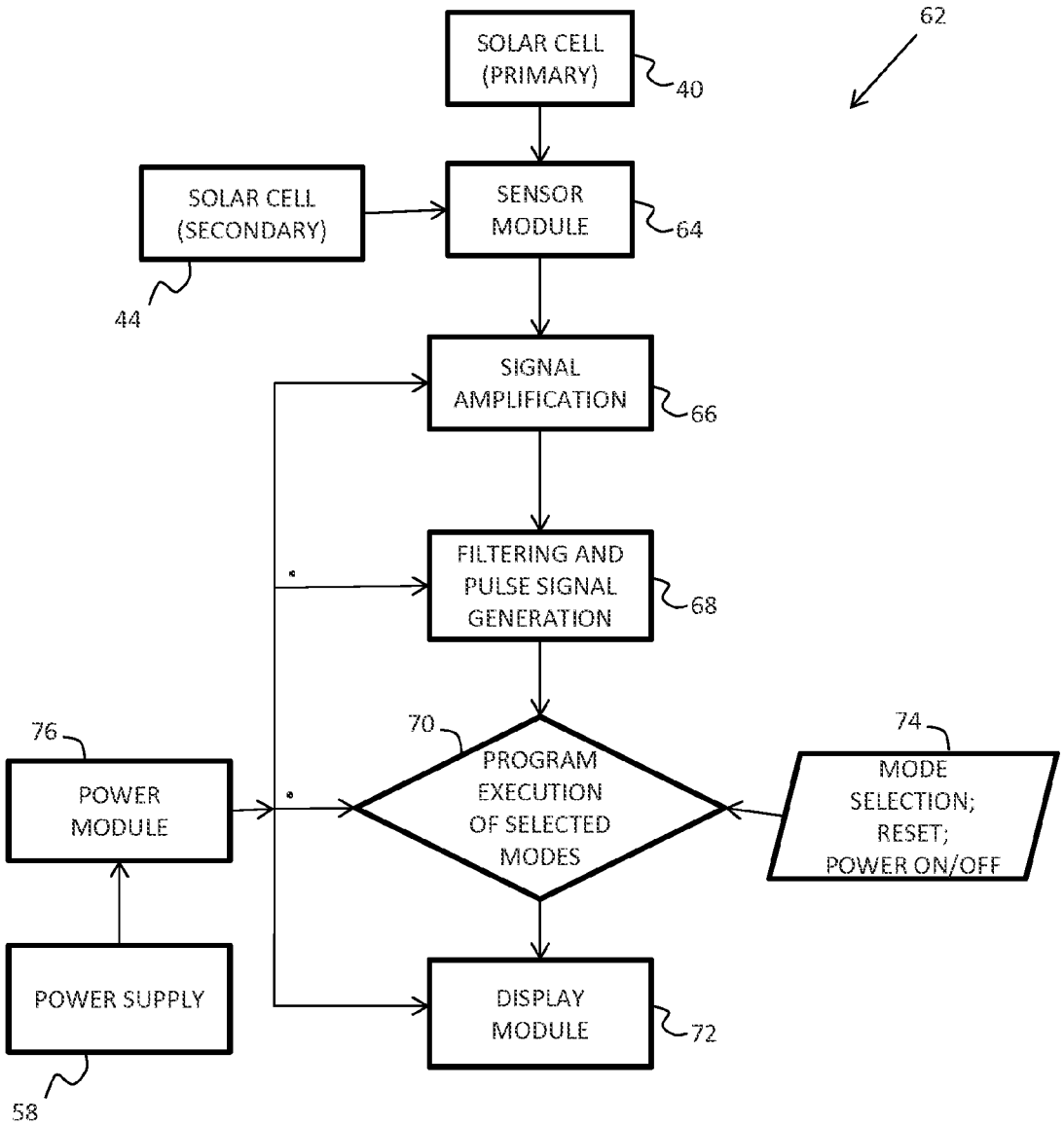
FIG. 7 is a schematic view of the system architecture of the target of FIG. 1.

FIG. 7 provides an overview of the electronic target's system architecture. The system architecture 62 may include a sensor module 64, a signal amplification module 66, a filtering and pulse signal train generation module 68, a program execution module 70, a display module 72, and a user input module 74. The electronic target's system architecture further may include a power module 76 and a power supply 78.

The sensor module 64 may include a circuit that is connected to the terminals of the solar cell 40. The circuit may incorporate passive elements (e.g., resistors and capacitors) exclusively. For example, the sensor module circuit may include an AC coupling connected to one terminal of the solar cell 40. This may be used to filter out electrical signals generated by ambient light and allow transient signals generated by a pulsed laser emission hitting the solar cell 40 to pass through to the signal amplification module 66. The sensor module may include a secondary input (e.g., phone jack 34). A user may connect one or more secondary solar cells 44 to the secondary input to provide multiple target sensors for generating transient signals. The secondary input 34 may be connected to another AC coupling in the sensor module circuit to filter out electrical signals generated by ambient light and allow transient signals generated by a pulsed laser emission hitting the solar cell 44 to pass through to the signal amplification module 66.

The signal amplification module 66 may receive output from the sensor module 64. The signal amplification module 66 may process signals from the sensor module and may include a circuit which incorporates passive elements (e.g., resistors and capacitors), as well as an operational amplifier. For instance, the operational amplifier may be set to a gain of two such that the signal output from the sensor module 64 may be doubled by the operational amplifier. The amplified signal, then, may pass through another AC coupling circuit.

The filtering and pulse signal train generation module 68 may receive output from the signal amplification module 66. The amplified signal may be passed through a band-pass circuit to selectively allow amplified signals of certain frequency to pass through to the next stage. The band-pass circuit may be a second degree filter. The high pass filter may include a first capacitor and the low pass filter may include another capacitor. The band-pass circuit may lower the voltage of non selected signal frequencies, but may amplify the voltage of selected signal frequencies. For example, the band-pass filter may have a wide band width and a center frequency of 2000 Hertz, a quality factor (or Q factor) of approximately 10, and a gain of approximately 3. A wide band pass may allow signals from various laser emission devices to be used with the target, but the bandwidth may be reduced to allow a more selective range of frequencies to pass. The output from the band-pass filter may be received by a comparator circuit, which includes another operational amplifier. The comparator may convert the analog signal output from the band-pass filter into a digital signal. The output signal from the comparator then may be received by the microcontroller 50 as an input signal from the solar cell.

The program execution module 70 includes the microcontroller 50. The microcontroller receives input signals from the various electronic components (e.g., the input switches 26*a*, 26*b*, 26*c* and the filtering and pulse signal train generation module 68), for executing programs of the selected mode.

Figure 8:
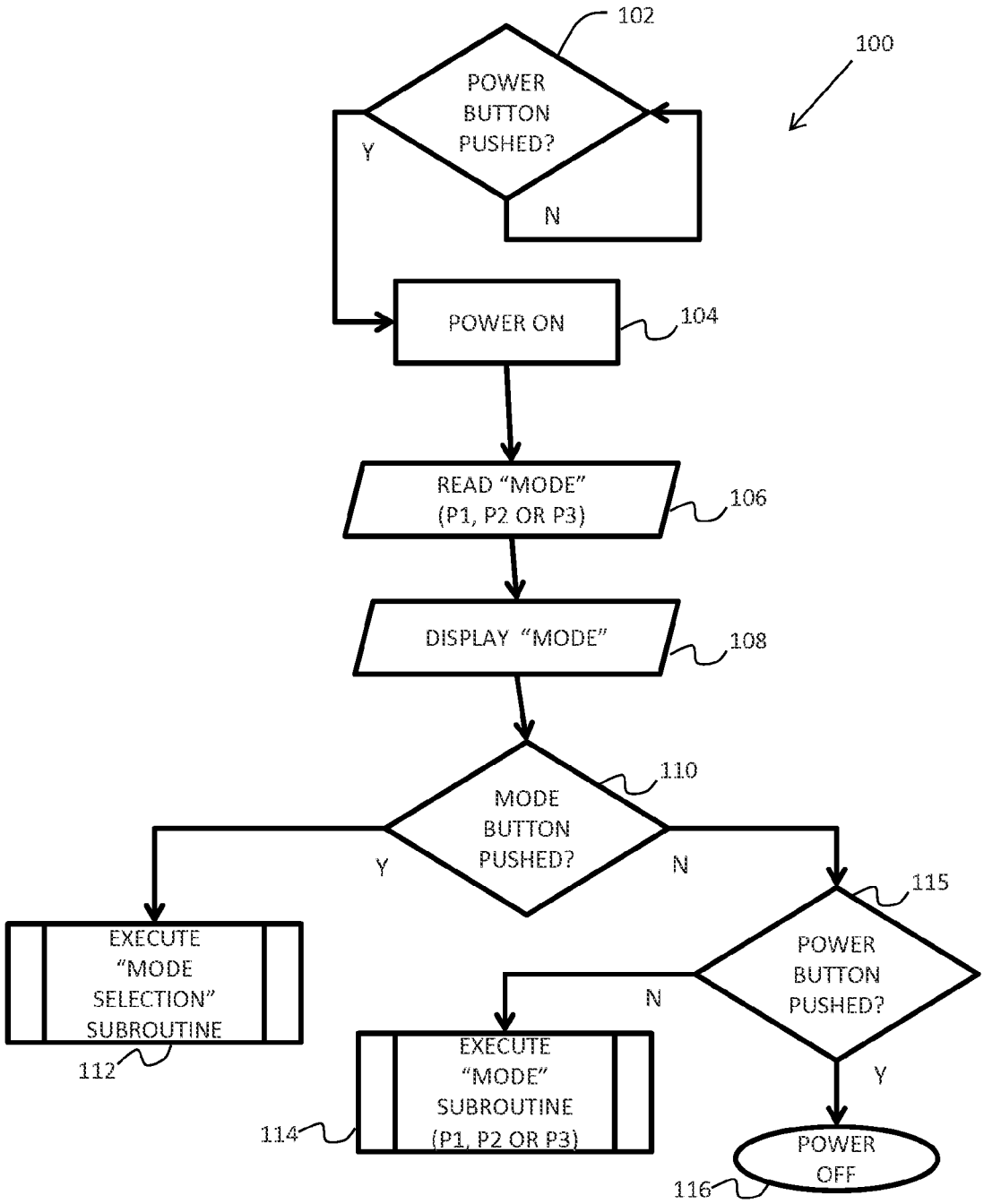
FIG. 8 is a flowchart for a general operating mode of the target of FIG. 1.

Program execution may include a first operational mode which is a general program that controls "Power-On," "Power-Off," and "Reset" functionality (FIG. 8). Program execution, further, may include second, third and fourth operational modes (e.g., subroutine P1 (FIG. 9), subroutine P2 (FIG. 10), and subroutine P3 (FIG. 11)). Additionally, a fifth operational mode may include a "mode selection" subroutine (FIG. 12).

The display module 72 may transmit program execution results from the microprocessor. The display module may include a five digit LED display 46 and five PMOS circuits (not shown), each of which controls one digit or decimal dot. The microcontroller 50 may post program returns to the electronic display 24 via the display module 72. Also, an audio signal circuit (not shown) may be connected to the microcontroller 50 to provide an audio alarm for certain program returns.

The system architecture may include a power module 76, which connects the power supply 58 to the electronic components of the electronic target. Further, the power module 76 may include a voltage regulator, a surge protector, and a reverse polarity protector. Preferably, the power supply 58 is two AAA batteries that are connected in series to deliver 3V of power to the power module.

Referring to FIG. 8, the electronic target enters a general program (or first operational mode) 100 after the power button (26*a*) is depressed 102, and the device powers up 104. The microcontroller reads the mode from memory 106 and then displays that mode (P1, P2, or P3) 108 on the electronic display. If the mode button (26*b*) is depressed (e.g., within two seconds after the mode is displayed) 110, then the microcontroller runs the mode selection subroutine 112. Otherwise, the microcontroller runs the mode subroutine (P1, P2 or P3) 114 that was retrieved from memory. If the power button is pushed when the device is powered up 115, then the microcontroller saves the current mode in memory and powers off 116.

Figure 9:
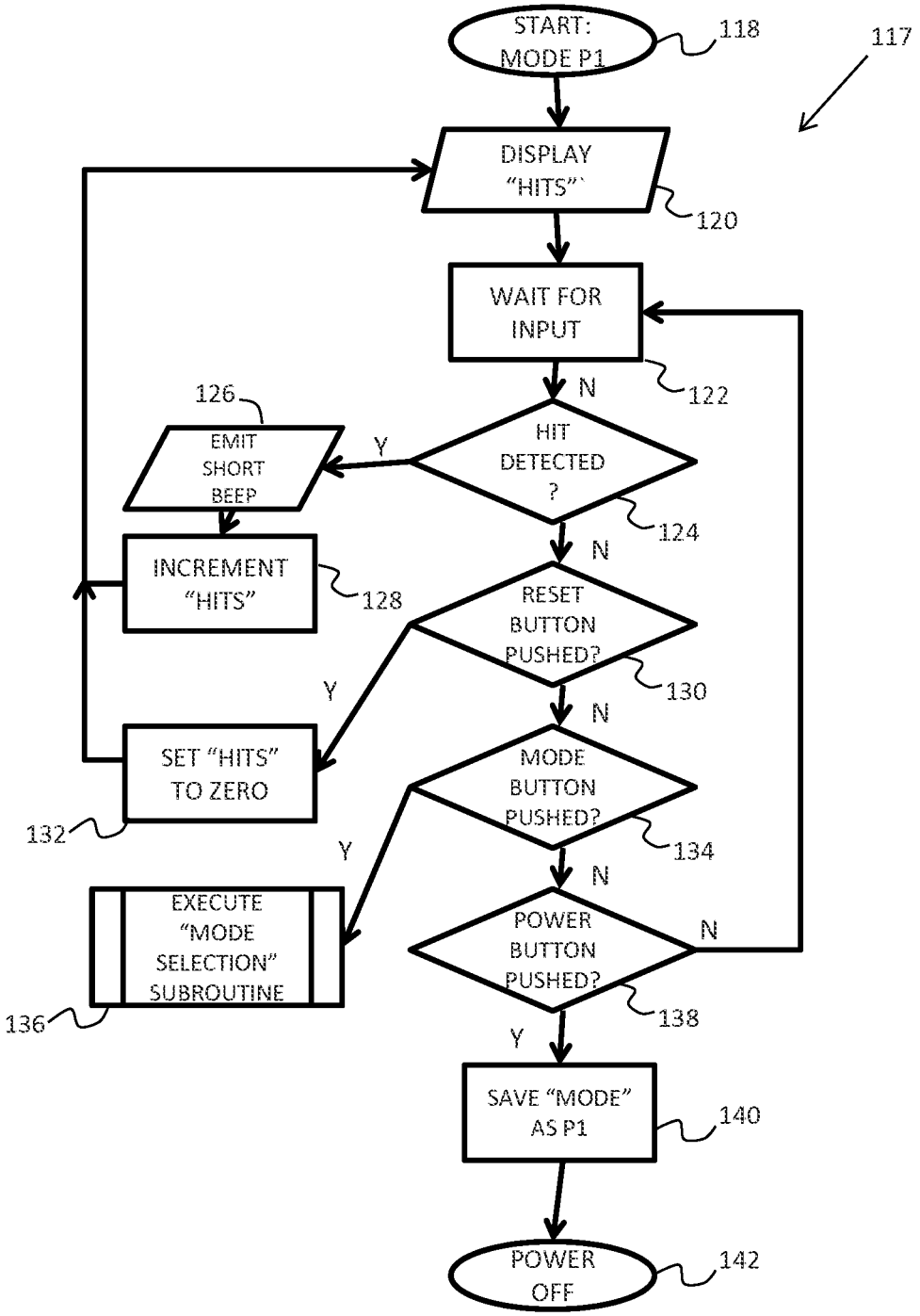
FIG. 9 is a process flowchart for mode P1 subroutine of FIG. 8.

Referring to FIG. 9, mode P1 (or the second operational mode) 117 starts 118 by displaying the number of hits 120 which at startup is zero. Next, the system waits for an input signal 122, which may be a hit registered by the electronic target or an input from one of the input buttons (Power, Reset and Mode). If the input is a hit 124, then the microcontroller signals the audio alarm to emit a short beep 126, and then increments the counter 128 that tracks the number of hits registered during the program session. The microcontroller then signals the display to show the updated number of hits 120, before waiting for the next input signal 122.

If the reset button is depressed 130, then the counter that tracks the number of hits registered during the program session is set to zero 132. The microcontroller then signals the display to show zero hits 120 before waiting for the next input signal 122. If the mode button is depressed 134, however, then the microcontroller starts to run the mode selection subroutine 136. If the power button is depressed 138, then the microcontroller saves the current mode (P1) in memory 140 and powers off 142.

Figure 10:
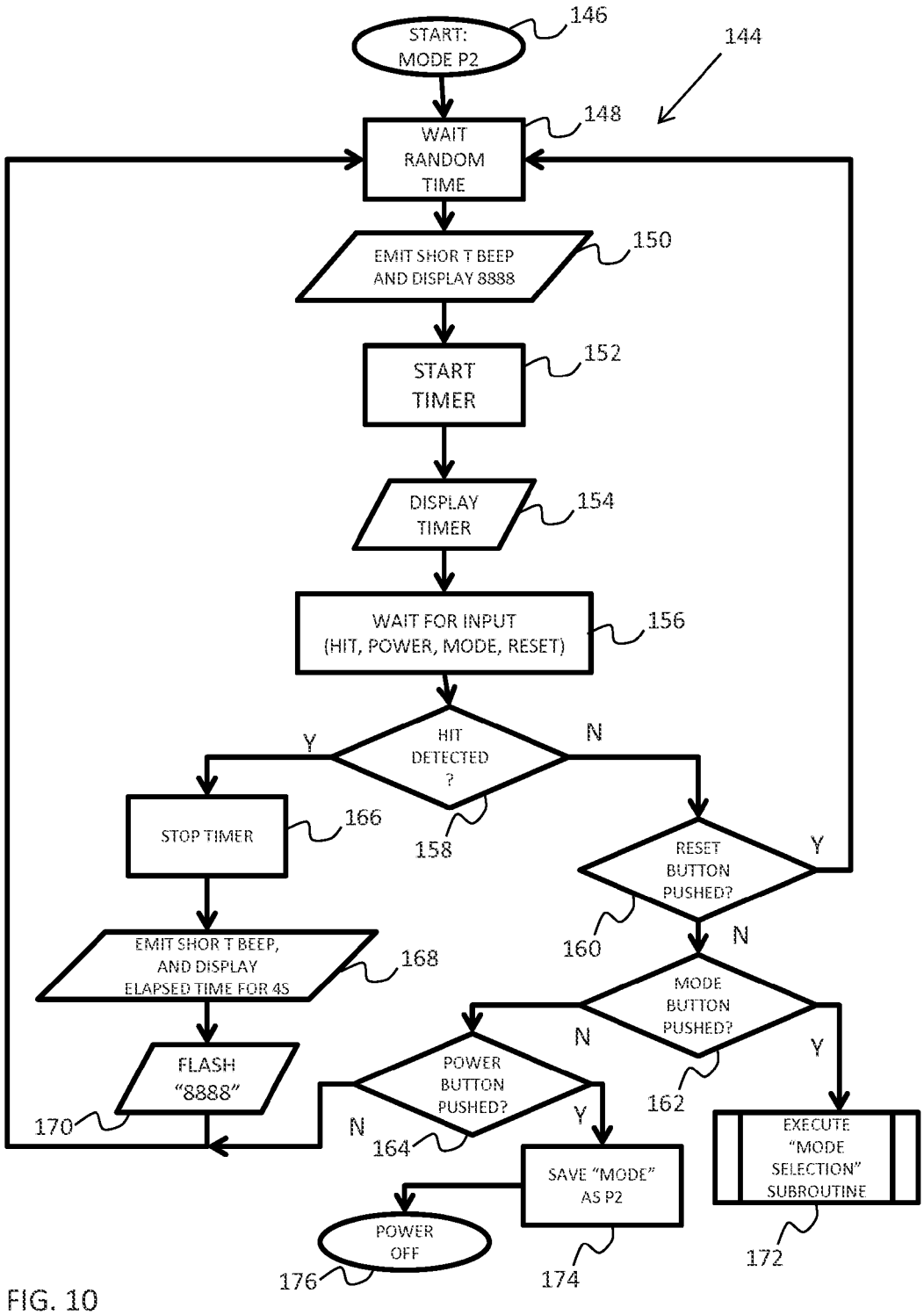
FIG. 10 is a process flowchart for a mode P2 subroutine of FIG. 8.

Referring to FIG. 10, mode P2 (or the third operational mode) 144 starts 146 by setting a random wait time 148 of between 2 and 8 seconds. The microcontroller signals the audio alarm to register an alarm (e.g., a short beep) and then signals the display to show or flash "8888" 150. The microcontroller starts a timer 152 and then displays the timer on the electronic display 154. The system then waits for an input signal 156, which may be a hit registered by the electronic target 158 or an input from one of the input buttons (Reset, Mode, Power) 160, 162, 164. If the input is a hit 158, then the microcontroller stops the timer 166 and displays the elapsed time 168 for four seconds. The microcontroller then instructs the display to flash "8888" 170, before initiating another iteration of the subroutine 148. If, however, the reset button is depressed 160, the microcontroller then initiates another iteration of the subroutine 148. If the mode button is depressed 162 then, the microcontroller starts to run the mode selection subroutine 172. If the power button is depressed 164, then the microcontroller saves the current mode (P2) in memory 174 and powers off 176.

Figure 11:
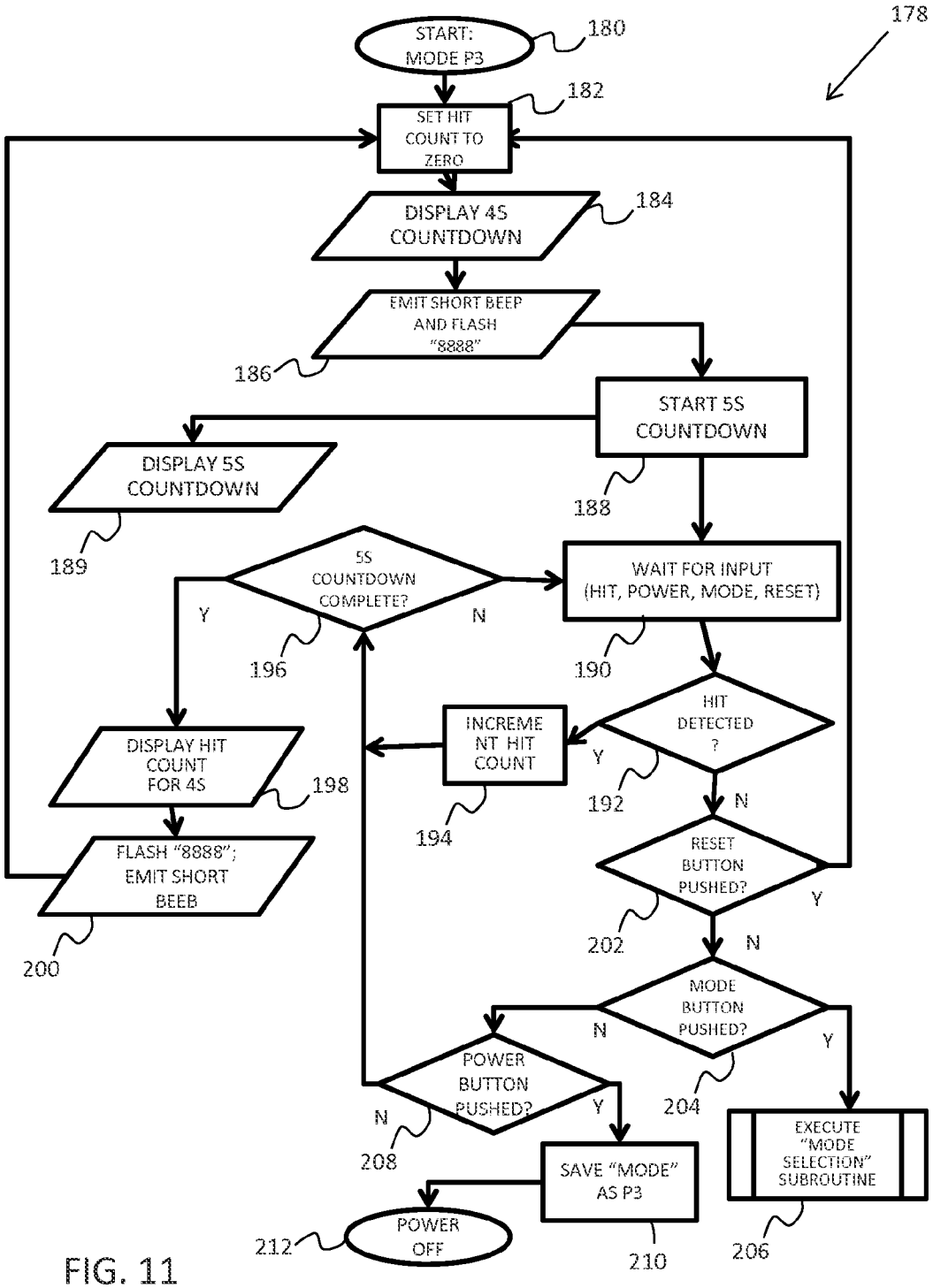
FIG. 11 is a process flowchart for a mode P3 subroutine of FIG. 8.
Figure 12:
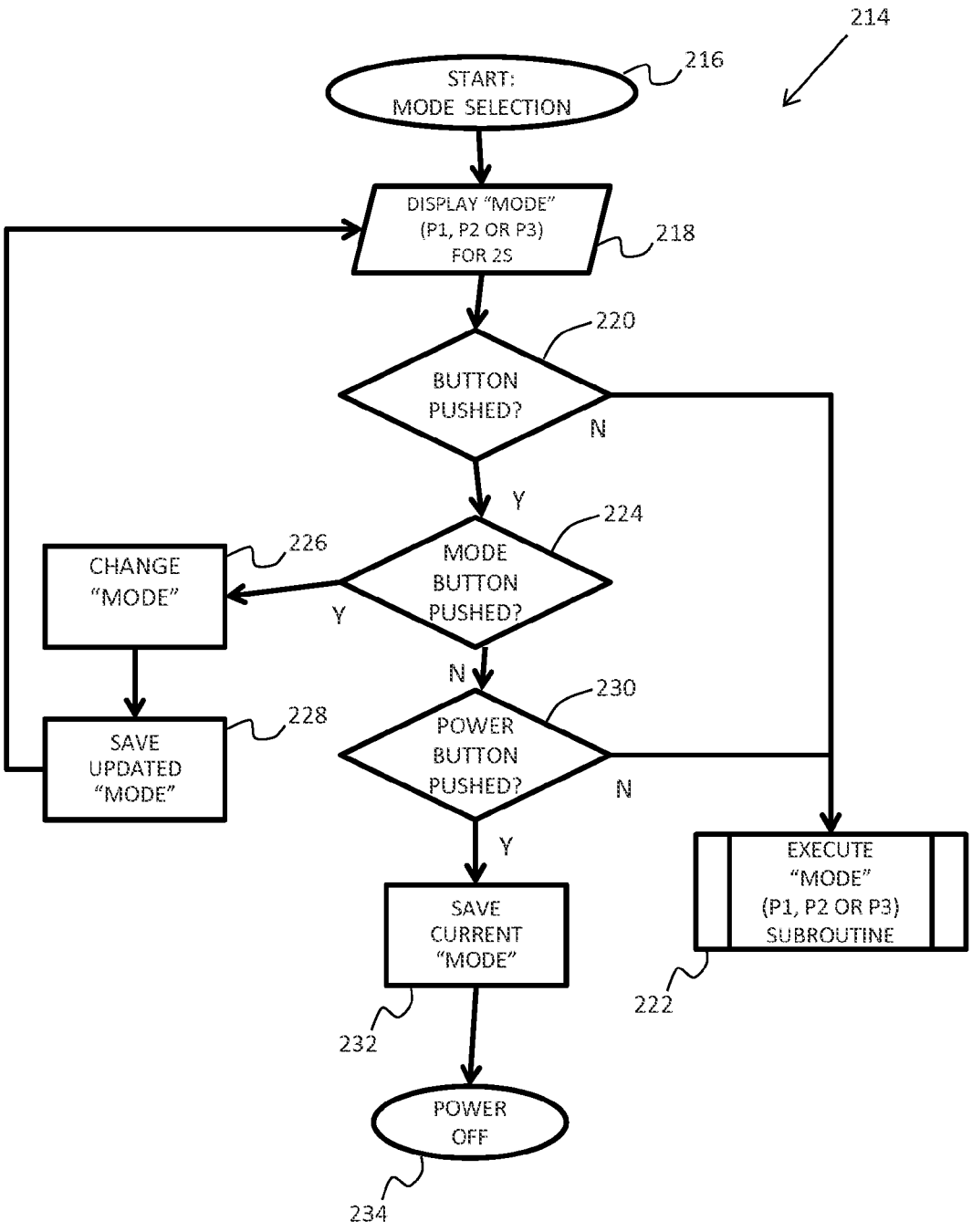
FIG. 12 is a process flowchart for the mode selection subroutine.

Referring to FIG. 11, mode P3 (or the fourth operational mode) 178, starts 180 by setting the hit counter to zero 182 and displaying a four second countdown in the electronic display 184. After the four second countdown 184 is completed, the microcontroller signals the audio alarm to emit a short beep and then instructs the display to flash "8888," 186. Next, the microcontroller starts 188 and displays a five-second countdown 189, while simultaneously waiting for an input signal 190. If the input is a hit 192 during the five-second countdown, the microcontroller increments the hit counter 194 which tracks the number of hits registered during the program session. After the five-second countdown is completed 196, the microcontroller signals the display to show the number of hits tracked by the counter 198. After the number of hits tracked by the counter is displayed for a few (e.g., four) seconds 198, the microcontroller signals the audio alarm to emit a short beep and instructs the display to flash "8888" 200. Next, the microcontroller initiates another iteration of the subroutine 182. Alternatively, if the reset button is depressed 202 during the 5 second countdown, the microcontroller initiates another iteration of the subroutine 182. If the mode button is depressed 204 then the microcontroller starts to run the mode selection subroutine 206. If the power button is depressed 208, then the microcontroller saves the current mode (P3) in memory 210 and powers off 212. If no hits are detected and none of the input buttons are depressed during the 5 second countdown the microcontroller continues to wait for an input signal 190.

Referring to FIG. 12, the mode selection subroutine (or fifth operational mode) 214 starts 216 by displaying the current mode for two seconds 218. If a signal from one of the input buttons 220 is not detected during the two second period, the microprocessor then executes the mode subroutine 222 that was displayed. If the mode button was pushed 224 during the two second period, the microprocessor changes the operational mode of the electronic device to the next mode 226 within a predetermined and repeating sequence (e.g., P1>P2>P2>P3>P1). The selected mode is then saved to memory 228, and another iteration of the subroutine is commenced 218. If the power button is depressed during the two second period 230, the microcontroller saves the current mode in memory 232 and powers off 234.

Figure 15:
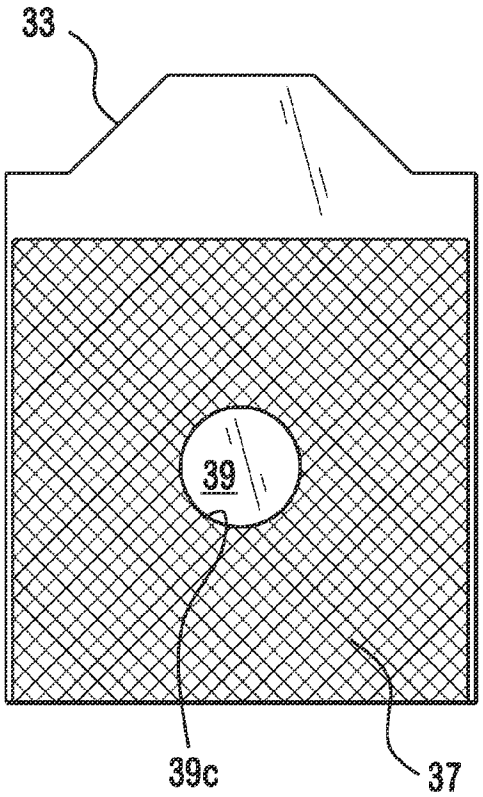
FIG. 15 is a plan view of another removable target mask for the target of FIG. 1.
Figure 14:
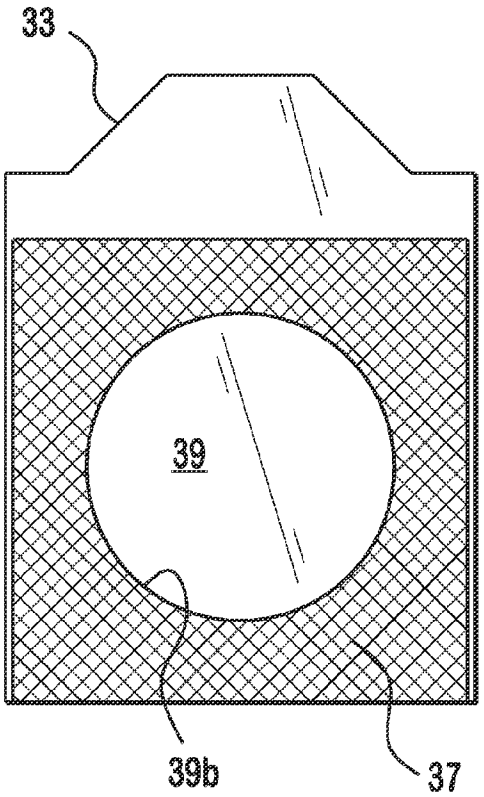
FIG. 14 is a plan view of another removable target mask for the target of FIG. 1.
Figure 13:
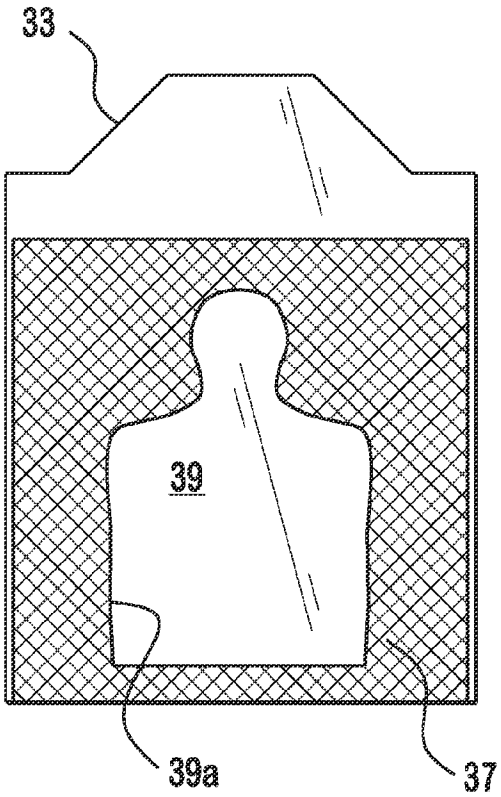
FIG. 13 is a plan view of a removable target mask for the target of FIG. 1.

Referring to FIGS. 13-15, the target mask 33 may include a clear sheet 35 of material that transmits visible light. The clear material may be overlaid with opaque material 37 that does not transmit visible light. For example, the opaque material may be a thin film with adhesive backing. In another example, the opaque material may be paint. Alternatively, the target mask may be formed from opaque material and the non-opaque areas may be areas of the opaque material that have been removed such that the target mask resembles a stencil. The opaque material may be contoured to form a silhouette of a form or shape. For example, in FIG. 13, the silhouette 39*a* is of the form of a human torso. In FIG. 14, the silhouette 39*b* is a circle of intermediate diameter in comparison to the uncovered target area. In FIG. 15, the silhouette 39*c* is a circle of smaller diameter compared to the silhouette of FIG. 14. The target mask may include a tab 33 on one side to facilitate insertion and removal from the slot 30.

FIG. 16 shows the electronic target 10 of FIG. 1 with the target mask of FIG. 13 mounted on a tripod 78. The tripod may be secured to the electronic target 10 at the base of the housing. The electronic target may be secured to the tripod with a screw that advances into the threaded bore 60 at the base of the housing.

FIG. 17 shows the electronic target 10 of FIG. 1 with the target mask of FIG. 14 connected to a second solar cell sensor target 80. The second solar cell sensor target 80 may be similar in construction to the electronic target 10. For example, the second solar cell sensor target 80 may include a housing 82, target window 84, target mask 86, protective sheet, and solar cell 44. The second solar cell sensor target 80 may include an external phone jack 88. An electrical cable 90 may be used to connect the external phone jack 88 to the phone jack 34 on the electronic target 10. In this manner, signals generated by the second solar cell sensor target 80 may be transmitted to the input terminals of the sensor module 64 for processing via the circuitry and devices resident in the electronic target. More than one additional solar cell may be connected to the phone jack 34 on the electronic target 10 by using one or more dual phone jack adaptors.

In use, the electronic target's operational modes may be used with a gun and suitable light emitting cartridge to develop shooting technique and firearm handling. Light emitting cartridges are disclosed in commonly owned, co-pending patent application Ser. No. 13/008,234, entitled "Dry Fire Training Device" filed on Jan. 18, 2011 (the '234 patent application). The '234 patent application is incorporated herein by reference in its entirety. Drill cartridges and adaptors for multi-caliber drill cartridge training are disclosed in commonly owned, co-pending patent application Ser. No. 13/190,135, entitled "Drill Cartridges, Adaptors, and Methods for Multi-Caliber Drill Cartridge Training" filed on Jul. 25, 2011 (the '135 patent application). The '135 patent application is incorporated herein by reference in its entirety.

The electronic target may be turned on by depressing and releasing the power button. The operational mode may then be selected by pressing the mode selection button. A user may then simulate firing a gun with a chambered light emitting drill cartridge at the electronic target. For example, a user may select subroutine P1 as the operational mode and then simulate firing the gun with a chambered light emitting drill cartridge at the electronic target. The electronic target will track and display a count of the user's consecutive hits of laser light upon the target's solar cell. Subroutine P2 may be selected and used to drill how quickly a user can place a shot of laser light on the target's solar cell. Subroutine P3 may be selected and used to practice burst shooting by counting the number of hits applied to the electronic target in 5-second intervals. Additionally, this mode may be used to simulate a magazine change. At the start of the four-second countdown in subroutine P3, a user may initiate a magazine change and then drill placing hits of laser light on the solar cell within the five-second interval. The electronic target may be powered off by depressing and releasing the power button.

In one embodiment, the electronic target may be configured and used for detecting an incident emission of pulsed laser light emitted from the barrel of a gun. For example, the pulsed laser light may be a beam of light having a predominant wavelength of between approximately 635 nm and 650 nm and a pulse duration of between 1 ms and 50 ms. As shown in FIG. 1, the electronic target 10 may include a housing 12 which includes a target window 18 and a solar cell (FIG. 5) proximate the target window such that the solar cell generates an electrical signal from an incident emission of pulsed laser light hitting the solar cell. Referring to FIG. 7, the electronic target may include a sensor module 64 electrically connected to the solar cell 40 such that the sensor module receives the electrical signal from the solar cell and passes a transient portion of the electrical signal for amplification. A signal amplification module 66 may be electrically connected to the sensor module such that the signal amplification module 66 receives the transient portion of the electrical signal from the sensor module, amplifies the transient portion of the electrical signal, and passes the amplified transient portion of the electrical signal for filtering and pulse generation. A filtering and pulse signal train generation module 68 may be electrically connected to the signal amplification module such that the filtering and pulse signal train generation module receives the amplified transient portion of the electrical signal from the signal amplification module, passes transient electrical signals of selected bandwidth from the signal amplification module for pulse signal generation, and converts the transient electrical signals of selected bandwidth into a pulse train signal.

A microcontroller 50 (FIG. 5) may be electrically connected to the filtering and pulse signal train generation module such that the microcontroller receives the pulse train signal as an input for program execution 70 (FIG. 7) and executes programming subroutines to affect operation of the electronic target. An electronic display 24 (FIG. 5) may be disposed adjacent the solar cell for displaying visual data, the electronic display being electrically connected to the microcontroller such that operation of the electronic display is regulated by the microcontroller. A plurality of input switches 26*a*, 26*b*, 26*c* (FIG. 6) may be disposed adjacent the electronic display, the plurality of input switches being electrically connected to the microcontroller such that the plurality of input switches selectively control operation of the electronic target.

The electronic target may further include a power module 76 (FIG. 7) electrically connected to the microcontroller 50, as well as a power supply 58 electrically connected to the power module. The power supply may include a plurality of batteries (FIG. 6). For instance, the power module may include a voltage regulator and the plurality of batteries may be two AA batteries.

Additionally, the plurality of input switches may include first, second and third normally open switches 26*a*, 26*b*, 26*c* (FIG. 2). The first, second, and third normally open switches may be push button switches. The first, normally open switch may be a power switch such that depressing the power switch moves the electronic target between a first state in which the target is operational and a second state in which the target is not operational. The first state may include a plurality of operational modes. The plurality of operational modes may include first, second, third, fourth and fifth operational modes.

The first operational mode (FIG. 8) may include executing a subroutine upon startup which includes reading a current mode value from the microcontroller memory, displaying the current mode value on the electronic display, and executing a current mode subroutine associated with the current mode value. The second, normally open switch may be a mode selection switch such that depressing the mode selection switch advances the target between the second, third, and fourth operational modes.

The second operational mode (FIG. 9) may include displaying a hit counter value on the electronic display such that the hit counter value counts events of incident emissions of pulsed laser light on the solar cell, detecting an incident emission of pulsed laser light on the solar cell, emitting an audible alarm that indicates a hit has been detected, incrementing the hit counter value, and displaying the hit counter value on the electronic display.

The third operational mode (FIG. 10) may include displaying a visual cue on the electronic display following a random delay, starting a timer, detecting an incident emission of pulsed laser light on the solar cell, stopping the timer, and displaying the elapsed time measured by the timer on the electronic display.

The fourth operational mode (FIG. 11) may include setting the hit counter value to zero, displaying a countdown on the electronic display, providing a visual cue on the electronic display, detecting an incident emission of pulsed laser light on the solar cell, incrementing the hit counter value, completing the countdown on the electronic display, and displaying the hit counter value on the electronic display.

The fifth operational mode (FIG. 12) may include reading the current mode value from the microcontroller memory, displaying the current mode value on the electronic display, depressing the mode switch to select an updated current mode value, storing the updated current mode value in the microcontroller memory, and executing the current mode subroutine associated with the updated current mode value.

Further, the electronic target may include an external phone jack connector 34 (FIG. 1), and the sensor module may include a first AC coupling circuit connected to the solar cell and a second AC coupling circuit connected to the external phone jack. Also, the electronic target may include a transparent thermoplastic sheet 20 (FIG. 5) overlying a portion of the solar cell, as well as a red light filter covering the solar cell.

The electronic target may be used in a method for detecting an incident emission of pulsed laser light emitted from a gun on an electronic target. The method may include providing an electronic target as described herein, initiating an operational mode of the electronic target, receiving an incident beam of light having a predominant wavelength of between approximately 635 nm and 650 nm and a pulse duration of between 1 ms and 50 ms on the solar cell, capturing an electrical signal generated by the solar cell from the incident beam of light, filtering the electrical signal through a filtering and pulse signal train generation module, detecting the incident emission of pulsed laser light on the solar cell, and displaying a hit count on the electronic display.

While it has been illustrated and described what at present are considered to be preferred embodiments of the present invention, it will be understood by those skilled in the art that various changes and modifications may be made, and equivalents may be substituted for elements thereof without departing from the true scope of the invention. Additionally, features and/or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. An electronic target for detecting an incident emission of pulsed laser light, the beam of light having a predominant wavelength of between approximately 635 nm and 650 nm and a pulse duration of between 1 ms and 50 ms, the electronic target comprising:

a housing which comprises a target window;

a solar cell proximate the target window such that the solar cell generates an electrical signal from an incident emission of pulsed laser light hitting the solar cell;

a sensor module electrically connected to the solar cell such that the sensor module receives the electrical signal from the solar cell and passes a transient portion of the electrical signal for amplification;

a signal amplification module electrically connected to the sensor module such that the signal amplification module receives the transient portion of the electrical signal from the sensor module, amplifies the transient portion of the electrical signal, and passes the amplified transient portion of the electrical signal for filtering and pulse generation;

a filtering and pulse signal train generation module electrically connected to the signal amplification module such that the filtering and pulse signal train generation module receives the amplified transient portion of the electrical signal from the signal amplification module, passes transient electrical signals of selected bandwidth from the signal amplification module for pulse signal generation, and converts the transient electrical signals of selected bandwidth into a pulse train signal;

a microcontroller electrically connected to the filtering and pulse signal train generation module such that the microcontroller receives the pulse train signal as an input for program execution and executes programming subroutines to affect operation of the electronic target;

an electronic display adjacent the solar cell for displaying visual data, the electronic display being electrically connected to the microcontroller such that operation of the electronic display is regulated by the microcontroller; and a plurality of input switches adjacent the electronic display, the plurality of input switches being electrically connected to the microcontroller such that the plurality of input switches selectively control operation of the electronic target.

2. The electronic target of claim 1, further comprising a power module electrically connected to the microcontroller.

3. The electronic target of claim 2, further comprising a power supply electrically connected to the power module.

4. The electronic target of claim 3, wherein the power supply comprises a plurality of batteries.

5. The electronic target of claim 4, wherein the power module includes a voltage regulator and the plurality of batteries are two AA batteries.

6. The electronic target of claim 1, wherein the plurality of input switches comprise first, second and third normally open switches.

7. The electronic target of claim 6, wherein the first, second, and third normally open switches are push button switches.

8. The electronic target of claim 7, wherein the first, normally open switch is a power switch such that depressing the power switch moves the target between a first state in which the target is operational and a second state in which the target is not operational.

9. The electronic target of claim 8, wherein the first state comprises a plurality of operational modes.

10. The electronic target of claim 9, wherein the plurality of operational modes comprises first, second, third, fourth and fifth operational modes.

11. The electronic target of claim 10, wherein the first operational mode comprises executing a subroutine upon startup which comprises:

reading a current mode value from the microcontroller memory;

displaying the current mode value on the electronic display; and executing a current mode subroutine associated with the current mode value.

12. The electronic target of claim 11, wherein the second, normally open switch is a mode selection switch such that depressing the mode selection switch advances the target between the second, third, and fourth operational modes.

13. The electronic target of claim 12, wherein the second operational mode comprises:

displaying a hit counter value on the electronic display such that the hit counter value counts events of incident emissions of pulsed laser light on the solar cell;

detecting an incident emission of pulsed laser light on the solar cell;

emitting an audible alarm that indicates a hit has been detected;

incrementing the hit counter value; and displaying the hit counter value on the electronic display.

14. The electronic target of claim 12, wherein the third operational mode comprises:

displaying a visual cue on the electronic display following a random delay, starting a timer, detecting an incident emission of pulsed laser light on the solar cell, stopping the timer, and displaying the elapsed time measured by the timer on the electronic display.

15. The electronic target of claim 12, wherein the fourth operational mode comprises setting the hit counter value to zero, displaying a countdown on the electronic display, providing a visual cue on the electronic display, detecting an incident emission of pulsed laser light on the solar cell, incrementing the hit counter value, completing the countdown on the electronic display, and displaying the hit counter value on the electronic display.

16. The electronic target of claim 15, wherein the fifth operational mode comprises reading the current mode value from the microcontroller memory;

displaying the current mode value on the electronic display; and depressing the mode switch to select an updated current mode value storing the updated current mode value in the microcontroller memory; and executing the current mode subroutine associated with the updated current mode value.

17. The electronic target of claim 1, further comprising an external phone jack connector, wherein the sensor module comprises a first AC coupling circuit connected to the solar cell and a second AC coupling circuit connected to the external phone jack.

18. The electronic target of claim 1, further comprising a transparent thermoplastic sheet overlying a portion of the solar cell.

19. The electronic target of claim 18, further comprising a red light filter covering the solar cell.

20. A method for detecting an incident emission of pulsed laser light emitted from a gun on an electronic target comprising:

providing an electronic target of claim 1;

initiating an operational mode of the electronic target;

receiving an incident beam of light having a predominant wavelength of between approximately 635 nm and 650 nm and a pulse duration of between 1 ms and 50 ms on the solar cell;

capturing an electrical signal generated by the solar cell from the incident beam of light;

filtering the electrical signal through a filtering and pulse signal train generation module;

detecting the incident emission of pulsed laser light on the solar cell; and displaying a hit count on the electronic display.

* * * * *